United States Patent [19]

Naret

[11] 4,262,903

[45] Apr. 21, 1981

[54] PADDLE RACQUET

[76] Inventor: Joseph Naret, 103 Marie Ave., Weirton, W. Va. 26062

[21] Appl. No.: 40,136

[22] Filed: May 18, 1979

[51] Int. Cl.[3] ..... A63B 59/00

[52] U.S. Cl. ..... 273/67 R

[58] Field of Search ..... 273/67 R, 67 A, 67 B, 273/72 R, 73 R, 73 C, 76, 167 E, 167 J; D21/213

[56] References Cited

U.S. PATENT DOCUMENTS

| | | | |
|---|---|---|---|
| D. 150,805 | 8/1948 | Pauly | 273/76 X |
| 1,530,427 | 3/1925 | Simon | 273/67 R X |
| 1,536,255 | 5/1925 | Beal | 273/76 |
| 1,697,846 | 1/1929 | Anderson | 273/67 R X |
| 2,156,477 | 5/1939 | Keller | 273/76 |
| 3,214,168 | 10/1965 | Sauber | 273/67 R |
| 3,261,607 | 7/1966 | Horowitz et al. | 273/67 R X |
| 4,062,541 | 12/1977 | Marks | 273/76 X |
| 4,079,935 | 3/1978 | Gormley | 273/67 R |
| 4,128,239 | 12/1978 | Grenadier | 273/67 R |

FOREIGN PATENT DOCUMENTS

| | | | |
|---|---|---|---|
| 16315 | 2/1934 | Australia | 273/73 C |
| 642134 | 6/1962 | Canada | 273/167 E |
| 1173824 | 7/1964 | Fed. Rep. of Germany | 273/76 |
| 2704011 | 8/1978 | Fed. Rep. of Germany | 273/76 |
| 607255 | 8/1948 | United Kingdom | 273/76 |

*Primary Examiner*—Richard J. Apley

*Attorney, Agent, or Firm*—Oldham, Oldham, Hudak & Weber Co.

[57] ABSTRACT

A paddle racquet having a substantially solid contact surface is provided for indoor and outdoor racquet sports. The racquet has a grip for a hand manipulation thereof connected to a substantially solid contact surface. The contact surface is textured with contact control indentations, composed of textured indentations and perforated indentations. The textured indentations reside on both the forehand and the backhand surface in a multiplicity of configurations. The perforated indentations reside on both forehand and backhand surfaces with a connection therethrough by a conical perforation. The base of the conical perforation communicates with the forehand surface, whereas the apex of the conical perforation communicates with the backhand surface. The perforated indentations establish a pattern in the contact control indentations to maximize flexibility of the substantially solid contact surface and minimize the wind resistance during use. The paddle racquet is adaptable for sports and recreation which require propulsion of the ball or other object according to the game's purpose.

9 Claims, 2 Drawing Figures

PADDLE RACQUET

BACKGROUND OF THE INVENTION

The present invention relates to the structure of a paddle racquet having a substantially solid contact surface having a multiplicity of contact control indentations.

Heretofore, recreational pursuits in racquet sports have been confined to the more traditional racquet sport. Typically, the public engaged in tennis, table tennis, platform tennis, racquetball, badminton and squash. These games have uniformly required special equipment and surroundings. The attributes of a strictly indoor game, such as table tennis, cannot be transferred to outside environment, whereas special court construction is necessary for outdoor games of racquet ball or squash.

Consequently, a need exists for the development of a paddle racquet that may be employed in both indoor and outdoor settings for a game which requires a minimum of space and does not require any adjoining walls for play.

SUMMARY OF THE INVENTION

Therefore, it is an object of the invention to provide a paddle racquet which may be adaptable to a racquet sport which is played in indoor and outdoor settings without expensive reconstruction or boundary lines.

Another object of the invention is to provide a paddle racquet with a substantially solid contact surface for use in such an adaptable and inexpensive game as described above.

It is another object of the invention to provide a paddle racquet which has contact control indentations in the substantially solid contact surface of the paddle racquet in order to provide control of the ball during contact with the same.

These and other objects, which will become more apparent as the detailed description of the preferred embodiments proceeds, are achieved by: a paddle racquet for use in indoor/outdoor racquet sports, comprising: (a) a substantially solid contact portion having a rim, a forehand surface, and a backhand surface, both said surfaces having a multiplicity of contact control indentations; (b) a handle portion having an axis; and (c) a neck portion securedly connecting said handle portion with said substantially solid contact portion.

DESCRIPTION OF THE DRAWINGS

For an appreciation of the scope and structure of the present invention, reference is had to the following drawings.

DETAILED DESCRIPTION OF THE PREFERRED EMBODIMENTS

Figure 1:
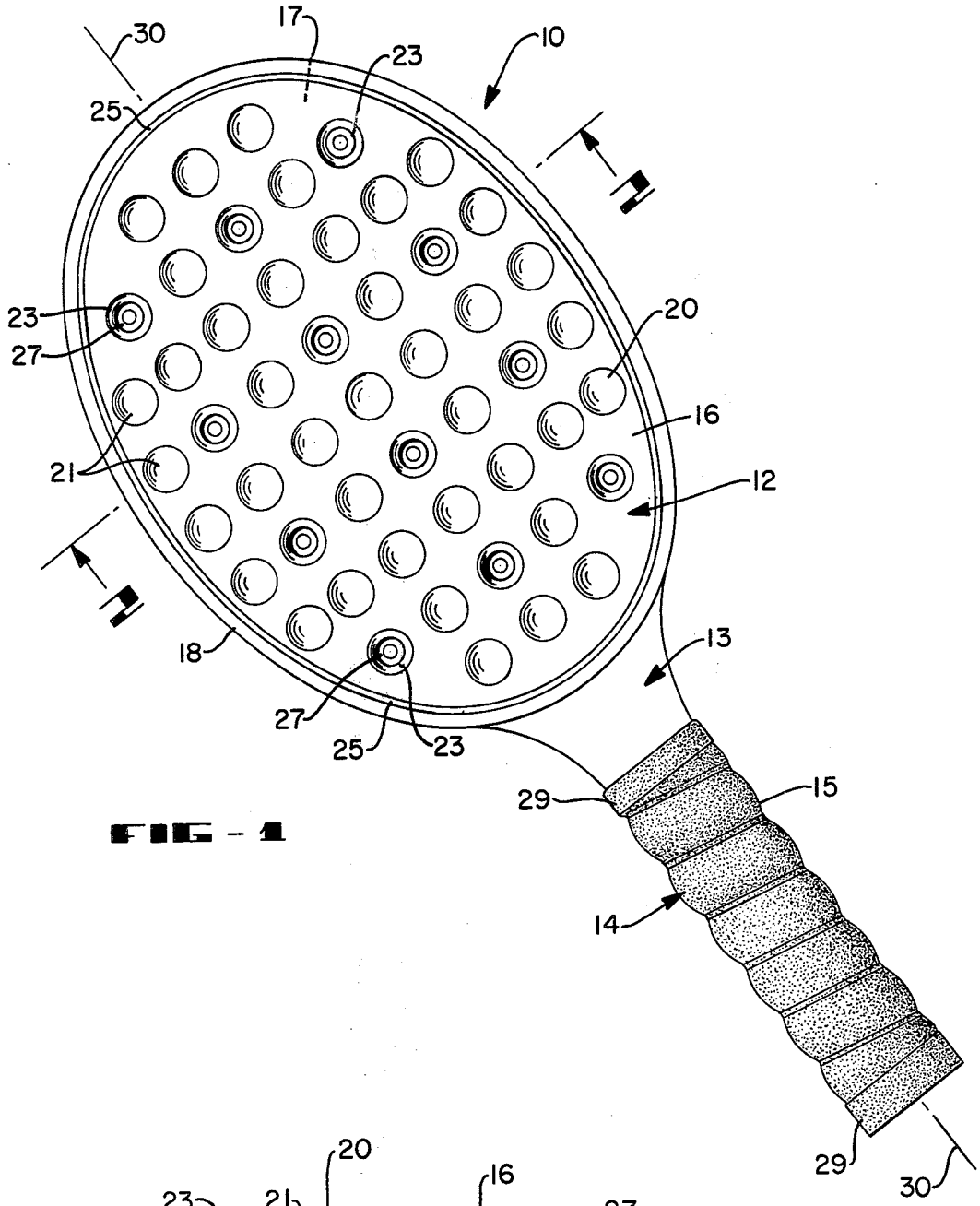
FIG. 1 is a front plan view of the paddle racquet.

Reference is had to FIG. 1 for an understanding of the structure of paddle racquet 10. Paddle racquet 10 is composed of a substantially solid contact portion 12, a neck portion 13, and a handle portion 14. The neck portion 13 must be of sufficient strength to maintain the rigid connection to the handle portion 14 and a sturdy connection to the contact portion 12. Surrounding handle portion 14 is a grip 15 which is of sufficient dimensions to provide adequate securement of the individual's hand to the paddle racquet 10.

The contact portion 12 of paddle racquet 10 is a substantially solid oval object composed of a rim 18, a substantially solid forward or forehand surface 16 and a substantially solid rearward or backhand surface 17. Whereas most racquets and paddles known to those skilled in the art have interchangeable contact surfaces, the contact portion 12 of paddle racquet 10 is differentiated between the forehand surface 16 and the backhand surface 17.

On both surfaces 16 and 17 reside a multiplicity of contact control indentations 20 and a peripheral groove 25. These contact control indentations are composed of two types: textured indentations 21 and perforated indentations 23. The multiplicity of contact control indentations 20 are sufficient adjacent to one another to provide a full contact portion 12 of paddle racquet 10 which may engage a tennis ball, a racquet ball, or other spheroid of similar size. The contact control indentations 20 provide the necessary control to the operation of the paddle racquet 10 during play which approximates other frictional surfaces used in racquet and paddle sports.

Textured indentations 21 comprise the majority of the multiplicity of contact control indentations 20. The textured indentations are indentations slightly recessed into the forehand surface 16 and backhand surface 17 of the contact portion 12. These textured indentations may be circular, square, or any other geometric two-dimensional configuration, which permits a pattern of such indentations 21 to exist on the entire surfaces 16 and 17 of contact portion 12. The peripheral groove 25 limits the area that the contact control indentations 20 are located on the contact portion 12. It has been found that a tennis ball is subject to much greater control by the user of the racquet when the textured indentations 21 exist in a pattern such as that presented in FIG. 1. The substantially solid surface would have minimal control over the tennis ball, were the textured indentations 21 not present. In paddle and racquet sports, control of the velocity, direction, and spin of the tennis ball after impact is a significant strategic ploy. The textured indentations 21 provide such control on both the forehand surface 16 and the backhand surface 17.

At identifiable positions on the contact portion 12, textured indentations 21 have been transformed into perforated indentations 23. The perforated indentations 23 on the forehand surface 16 communicate directly with the same indentations 23 on the backhand surface 17. The perforated indentations 23 provide access of wind passage during movement of the paddle racquet 10 in such manner as to increase the potential velocity at which the racquet 10 may travel. Failure to provide perforated indentations 23 would substantially reduce the force of impact by racquet 10 against a tennis ball or other projectile. The weight of the tennis ball and its momentum against the racquet would have a far greater effect upon the racquet than if the racquet has a greater force moving in the opposite direction as aided by the perforated indentations 23. The perforated indentations 23 may exist in a pattern which provides the passage of wind throughout the substantially solid surface of the contact portion 12. These indentations 23 have the same effect upon the tennis ball at impact as textured indentations 21, in that the surface of the ball does not penetrate the perforations. Consequently, the perforations must be of sufficiently small size to prevent disruption of the impact of the ball on the racquet 10 as controlled by textured indentations 21.

Figure 2:
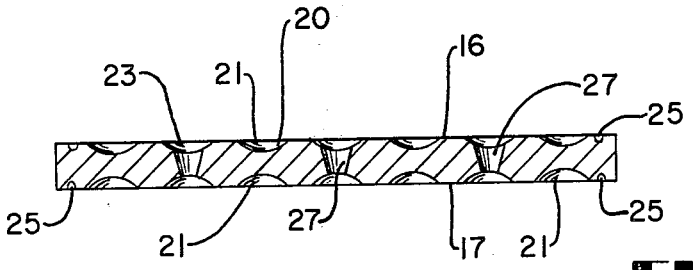
FIG. 2 is a cross sectional view taken from line 2—2 of FIG. 1.

The communication of the perforated indentations 23 between forehand surface 16 and backhand surface 17 takes the form of a conical passageway. The conical perforations 27, as seen by reference to FIG. 2, demonstrate the shape of such perforations 27. The base of each conical perforation 27 resides in perforated indentations 23 on the forehand surface 16 of the racquet 10. Conversely, the apex portion of each conical perforation 27 communicates with the perforated indentations 23 on the backhand surface 17. The effect of these conical perforations 27 further differentiates between the impact qualities of the forehand surface as opposed to the backhand surface. Movement of the racquet 10 in a forehand or forward direction directs the air through the conical perforations 27 so arranged and provides faster movement of the racquet 10 generating greater forces. Conversely, movement of the racquet 10 in a rearward or backhand direction meets greater resistance, in that less air is transferred through the conical perforations 27 having the narrowed opening as seen in FIG. 2. Less force is generated during the swing of racquet 10 by the user in the backhand or rearward stroke. The differentiation provides a tactical or strategic difference, which in competition may provide an advantage to the individual, unbeknownst to his competitor.

The paddle racquet 10 may be composed of any lightweight but sturdy material known to those skilled in the art. Typically, wood may be used for contact portion 12, neck portion 13, and handle portion 14. A leather or plastic grip 15 may be utilized over handle portion 14. Alternatively, a lightweight but sturdy metal, such as a specialty steel or magnesium, may replace the wood in its structural and contact functions. Also, a sturdy but flexible plastic may be employed in the contact, neck, or handle portions. The contact control indentations 20 may then be stamped or cut depending on the material used for the paddle racquet 10. Also, the conical indentations may be formed by suitable drilling techniques.

While the materials used to form paddle racquet 10 must be sturdy to resist the impact of the tennis ball or other ball in play, the materials must provide some flexibility to the impact to supplement the control obtained through contact control indentations 20. To that end, the perforated indentations 23 may be directed in a line along axis 30 to reduce the strength of the materials along the line of leverage force. The flexibility of the contact portion 12 with the perforated indentations 23 is achieved when the number of perforated indentations 23 along axis 30 permit resultant flexibility upon impact without reducing the overall strength of racquet 10.

Because the racquet 10 is a sturdy structure which the player uses to strike a ball traveling in an opposite direction, additional protection and padding to the handle portion 14 and neck portion 13 may be provided. Such protection may take the form of a rubber or elastomeric padding to absorb the shock of the impact of the ball. A layer of padding 29 is provided to the handle portion 14 and neck portion 13 of the racquet 10 shown in FIG. 1.

While in accordance with the patent statutes, the best mode and preferred embodiment known to the inventor of the present invention has been provided, the scope of the invention is not limited thereto or thereby. Consequently, for an understanding of the scope of the invention, reference is had to the following claims.

What is claimed is:

1. A paddle racquet for use in indoor/outdoor racquet sports, comprising:

(a) a substantially solid contact portion having a rim, a forehand surface, and a backhand surface, both said surfaces having a multiplicity of contact control indentations;

(b) a handle portion having an axis; and (c) a neck portion securedly connecting said handle portion with said substantially solid contact portion;

said contact control indentations comprising a multiplicity of textured indentations and a plurality of perforated indentations, each said perforated indentation on said forehand surface communicating with a conical perforation, each said conical perforation communicating with each said perforated indentation on said backhand surface, said forehand surface and said backhand surface differentiated by communication of the base of said conical perforation with said forehand surface and the communication of the apex of said conical perforation with the backhand surface effecting a differential air resistance between motion of said forehand surface and motion of said backhand surface.

2. A paddle racquet according to claim 1, wherein said perforated indentations are distributed evenly about both said surfaces of said substantially solid contact portion.

3. A paddle racquet according to claim 2, wherein said perforated indentations are in a pattern on both said surfaces parallel to said axis of said handle portion.

4. A paddle racquet according to claim 1, wherein said substantially solid contact portion is made from wood.

5. A paddle racquet according to claim 1, wherein said substantially solid contact portion is made from metal.

6. A paddle racquet according to claim 1, wherein said substantially solid contact portion is made from plastic.

7. A paddle racquet according to claim 1, wherein said handle portion and said neck portion have elastomeric padding and said handle portion has a grip.

8. A paddle racquet contact portion for contact with game balls or objects during racquet sports, comprising:

a substantially solid forehand surface having a multiplicity of textured indentations and a plurality of perforated indentations;

a backhand surface having a multiplicity of textured indentations and a plurality of perforated indentations;

each said perforated indentations on said forehand surface communicating with a conical perforation, each said conical perforation communicating with each said perforated indentation on said backhand surface, said forehand surface and said backhand surface differentiated by communication of the base of said conical perforation with said forehand surface and the communication of the apex of said conical perforation with the backhand surface effecting a differential air resistance between motion of said forehand surface and motion of said backhand surface.

9. A paddle racquet contact portion according to claim 8, wherein said perforated indentations are distributed evenly about said substantially solid forehand surface and said substantially solid backhand surface.

* * * * *